US005255062A

United States Patent [19]

Oka et al.

[11] Patent Number: 5,255,062

[45] Date of Patent: Oct. 19, 1993

[54] IMAGE FORMING APPARATUS HAVING A REMOVAL MEANS FOR SEPARATING DEVELOPERS

[75] Inventors: Tateki Oka, Atsugi; Hideyuki Kanbayashi; Kenji Tabuchi, both of Toyohashi, all of Japan

[73] Assignee: Minolta Camera Kabushiki Kaisha, Osaka, Japan

[21] Appl. No.: 819,188

[22] Filed: Jan. 10, 1992

[30] Foreign Application Priority Data

Jan. 14, 1991 [JP] Japan ..... 3-2567
Jan. 14, 1991 [JP] Japan ..... 3-2568
Jan. 14, 1991 [JP] Japan ..... 3-2569

[51] Int. Cl.[5] ..... G03G 15/01

[52] U.S. Cl. ..... 355/326; 118/645; 118/653; 355/203; 355/208

[58] Field of Search ..... 355/326, 327, 328, 203, 355/208, 245, 251, 246; 118/653, 656-658, 645; 346/157

[56] References Cited

U.S. PATENT DOCUMENTS

| | | | |
|---|---|---|---|
| 4,264,185 | 4/1981 | Ohta | 355/326 |
| 4,351,604 | 9/1982 | Karasawa et al. | 118/656 X |
| 4,545,325 | 10/1985 | Komatsu et al. | 118/645 |
| 4,618,243 | 10/1986 | Knapp | 118/645 X |
| 4,724,459 | 2/1988 | Ford | 355/326 |
| 4,774,543 | 9/1988 | Yoshikawa et al. | 355/326 |
| 4,822,702 | 4/1989 | Hoshi et al. | 430/42 |
| 5,063,127 | 11/1991 | Oka et al. | 355/326 X |
| 5,134,444 | 7/1992 | Tabuchi et al. | 355/326 |

FOREIGN PATENT DOCUMENTS 58-102251 6/1983 Japan .

*Primary Examiner*—A. T. Grimley
*Assistant Examiner*—William J. Royer
*Attorney, Agent, or Firm*—Burns, Doane, Swecker & Mathis

[57] ABSTRACT

A multi-color image forming apparatus which comprises a rotatably supported photoreceptor drum movable sequentially past a first charging station at which the photoreceptor drum is electrostatically charged; a first exposure station at which a first electrostatic latent image is formed on the photoreceptor drum; a first developing station at which a first developing unit is disposed for developing the first electrostatic latent image into a toner image with a first toner material; a second charging station at which the photoreceptor drum is again electrostatically charged; a second exposure station at which a second electrostatic latent image is formed on the photoreceptor drum; a second developing station at which a second developing unit is disposed for developing the second electrostatic latent image into a toner image with a second toner material; a transfer station at which the toner image is transferred onto a recording medium; and a cleaning station. To avoid a color mixing as a result of an mixture of the first toner material into the second developing unit, the first toner material mixing into the second developing unit is separated and recovered from the second developing unit. A manually operated switch and a control system are provided for manually controlling the separation and recovery of the first toner material from the second toner material.

16 Claims, 12 Drawing Sheets

IMAGE FORMING APPARATUS HAVING A REMOVAL MEANS FOR SEPARATING DEVELOPERS

BACKGROUND OF THE INVENTION

1. Field of the Invention

The present invention generally relates to the art of electrophotography and, more particularly, to a multicolor image forming apparatus, such as, for example, a multicolor printer or a multicolor copying machine, of a type operable according to an electrophotographic two-color image forming process.

2. Description of the Related Art

An electrophotographic two-color image forming apparatus has hitherto been proposed which comprises first and second developing units disposed in the vicinity of a photoreceptor for accommodating first and second toner materials of different colors, respectively, so that a first electrostatic latent image formed on the photoreceptor can be developed with the first toner material into a first toner image and a second electrostatic latent image formed on the photoreceptor can be developed with the second toner material into a second toner image, the first and second toner images being subsequently transferred at a time onto a transfer medium to provide a two-color image.

It has however been found that the above described two-color image forming method has a problem in that the first toner image formed with the first toner material may, during a passage thereof past the second developing unit, contact and then mix into a second developing material to such an extent that, with an increase of the number of prints being made, the second developing material becomes impure and the continued use of the impure second developing material will eventually result in that the image formed with the second developing material will show a mixed color. This problem is particularly considerable where the second developing unit is of a magnetic brush type. Considering that the magnetic brush developing unit is of a design capable of accomplishing a development by causing magnetic brush bristles, made of toner particles and carrier particles, to contact the photoreceptor, the use of the magnetic brush developing unit for the second developing unit will result in that the first toner material may be physically removed by the magnetic brush bristles from the photoreceptor.

In view of the foregoing, in order to separate and recover the first toner material from the second developing material, a method has been suggested in, for example, U.S. Pat. No. 4,822,702 issued Apr. 18, 1989, wherein the first toner material mixed into the second toner material is reversed to a polarity opposite to that of charges on the second toner material so that the first toner material can be electrostatically separated from the second toner material. Another method has also been suggested in, for example, the Japanese Laid-open Patent Publication No. 58-102251, published Jun. 17, 1983, wherein the use has been made of the first and second toner materials having different developing threshold values and, in other words, a difference is given to a development initiating potential of the toner material, while a recovery roll to which a bias voltage is applied is used to separate the first toner material from the second toner material.

According to the foregoing suggested separating methods, while it is theoretically possible to separate only the first toner material from the second developing material, a complete separation is not possible since in practice the first toner material being recovered contains a substantial amount of the second toner material. Because of this, when the first toner material is separated and recovered, the second toner material is also recovered, resulting in an unnecessary waste of the second toner material.

While this problem may to a certain extent eliminated if stringent conditions are employed when the first toner material is to be separated, the employment of the stringent conditions may bring about a limitation to the type and the range of the toner material that can be employed or may not accommodate a change in chargeability of the toner material which would occur as a result of a change in environment. Therefore, the employment of the stringent conditions for the separation of the first toner material cannot be regarded as an effective means to accomplish a satisfactory separation of the first toner material from the second toner material.

SUMMARY OF THE INVENTION

Accordingly, the present invention has been developed with a view to substantially eliminating the above discussed problems and is intended to provide a minimization of the unnecessary waste of the second toner material which would occur during the recovery of the toner material having mixed thereinto.

Another important object of the present invention is to provide a substantial elimination of a problem associated with a lowering of the toner density of a developing material which would otherwise occur as a result of an actuation of a mixed toner recovery means.

A further important object of the present invention is to avoid a color mixing as a result of an mixture of the first toner material into the second developing unit and, hence, to separate and recover the first toner material mixing into the second developing unit from the second developing unit.

The foregoing objectives of the present invention can be accomplished by numerous ways. Specifically, according to one aspect of the present invention, there is provided a multi-color image forming apparatus which comprises a photosensitive medium; a first latent image forming means for forming a first electrostatic latent image on the photosensitive medium; a first developing unit for developing the first electrostatic latent image with a first toner material of a first color; a second latent image forming means for forming a second electrostatic latent image on the photosensitive medium; a second developing unit for developing the second electrostatic latent image with a second toner material of a second color different from the first color; a removal means for removing the first toner material mixing into the second developing unit; a manually operable switch for activating the removal means; and a control means for activating the removal means in response to the manually operable switch having been turned on.

The image forming apparatus may further comprise a detecting means for detecting an amount of the first toner material mixing into the second developing unit. In this case, the control means may activate the removal means in the event that said manually operable switch is switched on and the amount of the first toner material detected by the detecting means is greater than a predetermined value.

Also, in place of the use of the manually operable switch and the control means designed to activate the removal means in response to the manually operable switch having been turned on, a combination may be employed of a selector means for selecting one of a first mode, in which the electrostatic latent image is developed with the use of one of the developing units, and a second mode in which the electrostatic latent image is developed with the use of both of the first and second developing units; a counting means for counting the number of times over which the electrostatic latent image is developed under the second mode; a detecting means for detecting an amount of the first toner material mixing into the second developing unit; and a control means for activating the removal means in the event that said counting means counts a predetermined number of the times over which the electrostatic latent image has been developed under the second mode and the amount of the first toner detected by the detecting means exceeds a predetermined value.

According to another aspect of the present invention, there is also provided a multi-color image forming apparatus which comprises a photosensitive medium; a latent image forming means for forming an electrostatic latent image on the photosensitive medium; a first developing unit for developing the electrostatic latent image with a first toner material of a first color; a second developing unit for developing the electrostatic latent image with a second toner material of a second color different from the first color; a removal means for removing the first toner material mixing into the second developing unit; a selector means for selecting one of a first mode, in which the electrostatic latent image is developed with the use of one of the developing units, and a second mode in which the electrostatic latent image is developed with the use of both of the first and second developing units; a counting means for counting the number of times over which the electrostatic latent image is developed under the second mode; and a control means for activating the removal means in the event that said counting means counts a predetermined number of the times over which the electrostatic latent image has been developed under the second mode.

According to a still further aspect of the present invention, there is provided a multi-color image forming apparatus which comprises a photosensitive medium; a first latent image forming means for forming a first electrostatic latent image on the photosensitive medium; a first developing unit for developing the first electrostatic latent image with a first toner material of a first color; a second latent image forming means for forming a second electrostatic latent image on the photosensitive medium; a second developing unit for developing the second electrostatic latent image with a second toner material of a second color different from the first color; a removal means for removing the first toner material mixing into the second developing unit; and a replenishing means for replenishing the second toner material into the second developing unit incident to an activation of the removal means.

BRIEF DESCRIPTION OF THE DRAWINGS

These and other objects and features of the present invention will become clear from the following description taken in conjunction with preferred embodiments thereof with reference to the accompanying drawings, in which.

DETAILED DESCRIPTION OF THE EMBODIMENTS

For facilitating a better understanding of the present invention, various preferred embodiments of the present invention will be described under separate headings.

FIRST EMBODIMENTS (FIGS. 1 TO 8)

Figure 1:
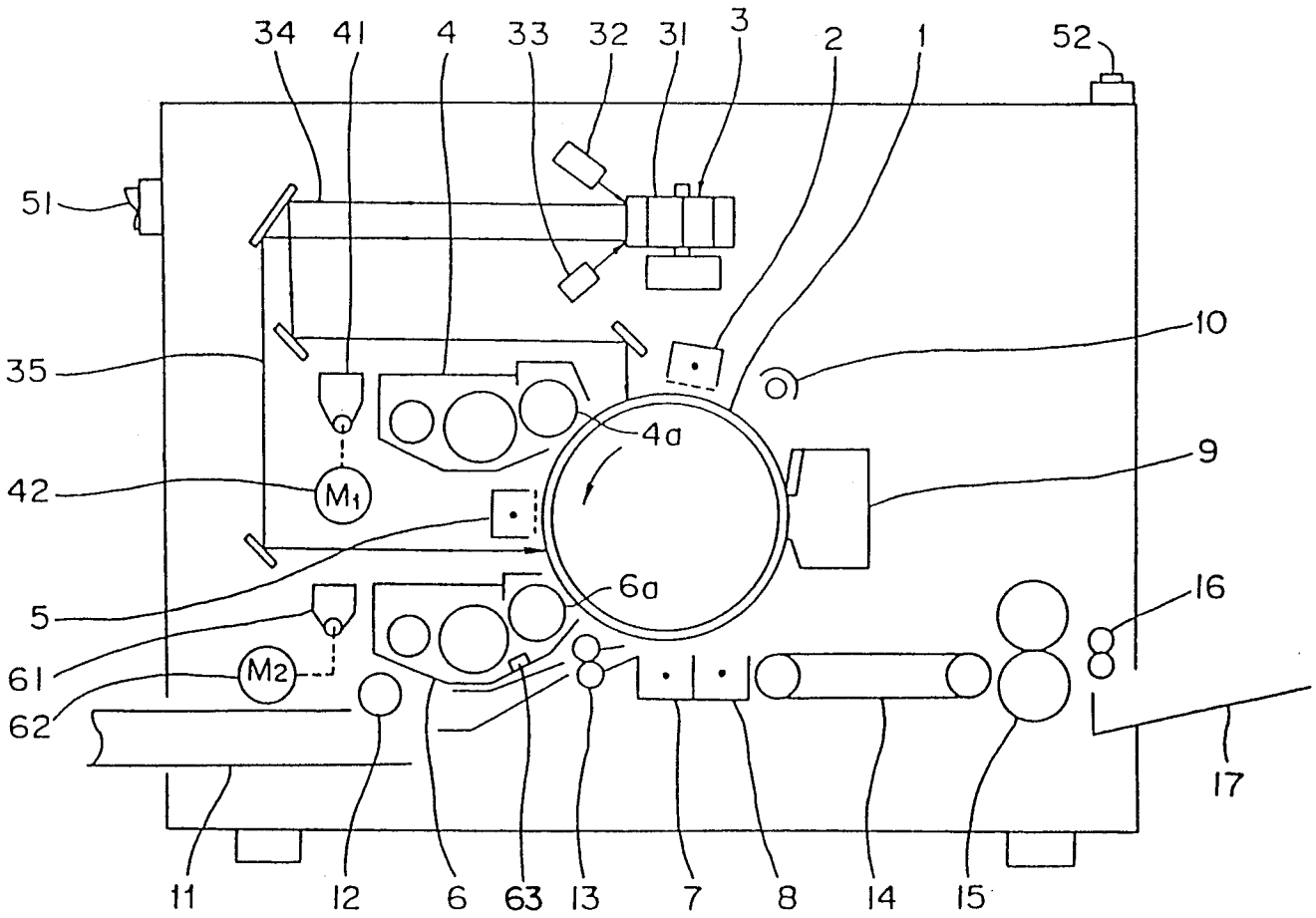
FIG. 1 is a schematic sectional view of an electrophotographic printer.

Referring first to FIG. 1, there is schematically shown a sectional representation of an electrophotographic printer operable according to an electrophotographic process. The printer shown therein comprises a photoreceptor drum 1 positioned at a generally central portion of a printer housing and supported for rotation in one direction past a plurality of processing stations that are defined around the photoreceptor drum 1. These processing stations include a first charging station at which a first electrostatic charger 2 is disposed; a first exposure station; a first developing station at which a first developing unit 4 is disposed; a second charging station at which a second electrostatic charger 5 is disposed; a second exposure station; a second developing station at which a second developing unit 6 is disposed; a transfer station at which an electrostatic transfer charger 7 is disposed; a separating station at which a separation charger 8 is disposed; and a cleaning station at which a cleaning unit 9 and an eraser 10 are disposed.

The illustrated printer also comprises an optical system 3 disposed substantially above the photoreceptor drum 1 and including a polygonal scanner 31 and first and second laser heads 32 and 33 for projecting image-wise laser beams 34 and 35, corresponding to an image to be printed or copied, onto the polygonal scanner 31; a paper supply cassette 11 positioned at a lower left portion of the printer housing as viewed in FIG. 1 and accommodating therein a stack of transfer or recording media such as, for example, recording papers; and a fixing unit 15 positioned at a lower right portion of the printer housing as viewed in FIG. 1.

The recording papers in the paper supply cassette 11 can be successively fed one at a time therefrom by means of a supply roller 12 and then towards the transfer station by way of a timing roller pair 13 positioned adjacent the transfer charger 7 and operable to synchronize an arrival of each recording paper at the transfer station with an arrival of a toner image formed on the photoreceptor drum 1. The recording paper having the toner image transferred thereonto at the transfer station is separated from the photoreceptor drum 1 at the separation station and is then conveyed towards the fixing unit 15 through an endless belt 14. The recording paper having the toner image fixed thereon during the passage thereof through the fixing unit 15 is subsequently ejected onto a print receiving tray 17 by means of a delivery roller pair 16.

The first developing unit 4 is of a so-called magnetic brush type and includes a developing roll 4*a* positioned adjacent the photoreceptor drum 1. The developing roll 4*a* employed in the first developing unit 4 is of a type comprising a rotatably supported sleeve enclosing a stationary roll of magnets positioned inside the sleeve. This first developing unit 4 accommodates therein a mass of two-component type developing material consisting of toner particles and carrier particles (which is hereinafter referred to as a first developing material). The carrier particles are in the form of globular ferrite particles and the toner particles are in the form of non-magnetizable red toner particles, said carrier particles and said toner particles being capable of triboelectrically charged to a positive potential and a negative potential, respectively, when the both are held in frictional contact with each other. As shown, the first developing unit 4 has a toner hopper 41 fitted thereto, said toner hopper 41 accommodating therein a mass of the red toner particles which can be supplied from the toner hopper 41 towards the first developing unit 4 during a drive of a motor 42.

The second developing unit 6 is also of a so-called magnetic brush type and includes a developing roll 6*a* positioned adjacent the photoreceptor drum 1. The developing roll 6*a* employed in the second developing unit 6 is of a type comprising a rotatably supported sleeve enclosing a stationary roll of magnets positioned inside the sleeve. This second developing unit 6 accommodates therein a mass of two-component type developing material consisting of toner particles and carrier particles (which is hereinafter referred to as a second developing material). The carrier particles are in the form of binder-type carrier particles and the toner particles are in the form of magnetizable black toner particles, said carrier particles and said toner particles being capable of triboelectrically charged to a positive potential and a negative potential, respectively, when the both are held in frictional contact with each other. As shown, the second developing unit 6 has a toner hopper 61 fitted thereto, said toner hopper 61 accommodating therein a mass of the black toner particles which can be supplied from the toner hopper 61 towards the second developing unit 6 during a drive of a motor 62.

Figure 2:
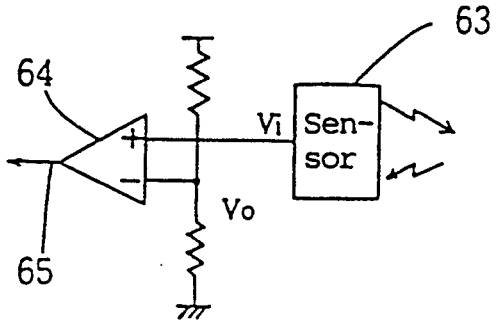
FIG. 2 is a circuit diagram showing a detecting circuit for detecting the quantity of a mixed toner material.

The second developing unit 6 also comprises, as shown in FIGS. 1 and 2, a photoelectric sensor assembly for detecting a color mixing degree of the second developing material, that is, the extent to which the second developing material has been mixed with the first developing material. This photoelectric sensor assembly includes a photoelectric sensor 63 disposed inside the second developing unit 6 and a comparator 64. The photoelectric sensor 63 is of a type capable of radiating rays of light towards the second developing material and subsequently generating a sensor output voltage Vi proportional to the amount of light reflected from the second developing material and detected thereby. The sensor output voltage Vi is then supplied to one of input terminals of the comparator 64. The other of the input terminals of the comparator 64 is a reference voltage input terminal which is electrically connected with a reference voltage generator applying thereto a reference voltage Vo representative of a maximum allowable color mixing degree over which a color mixing is deemed as noticeable in an eventually formed image. The comparator 64 therefore compares the sensor output voltage Vi with the reference voltage Vo and then generates a comparator output 65 which may be in a high level state if the sensor output voltage Vi is higher than the reference voltage Vo and in a low level state if the sensor output voltage Vi is lower than the reference voltage Vo. The high level state of the comparator signal 65 represents an excess of the color mixing degree of the second developing material over the maximum allowable color mixing degree and, conversely, the low level state of the comparator signal 65 represents that the color mixing degree of the second developing material is still lower than the maximum allowable color mixing degree.

Figure 3:
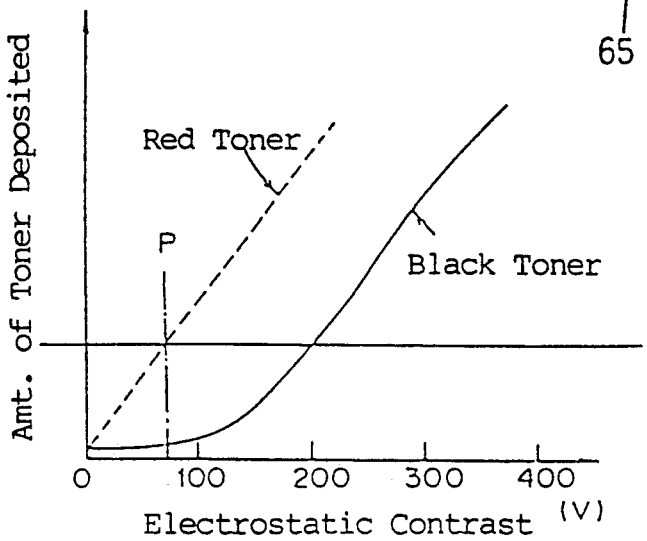
FIG. 3 is a graph showing developing characteristics of a toner material.

As hereinbefore described, the first developing material within the first developing unit 4 contains the non-magnetizable red toner particles, and the second developing material within the second developing unit 6 contains the magnetizable black toner particles. FIG. 3 illustrates a relationship between the weight of any one of the non-magnetizable red toner particles and the magnetizable black toner particles, which are deposited on the photoreceptor drum 1, and an electrostatic contrast (expressed in terms of volts). The electrostatic contrast referred to above represents a voltage which participates in causing the toner particles to electrostatically deposit on the photoreceptor drum 1.

As can be understood from the graph of FIG. 3, the amount of the non-magnetizable red toner particles deposited on the photoreceptor drum 1, shown by the broken line, increases in proportion to an increase of the electrostatic contrast which starts generally from a position of zero volt. In contrast thereto, the amount of the magnetizable black toner particles deposited on the photoreceptor drum 1, shown by the solid line, depicts a curve showing that, while little black toner particles are deposited on the photoreceptor drum 1 up until the electrostatic contrast reaches a position of 70 volts, an increase of the amount of the black toner particles deposited on the photoreceptor drum 1 takes place when and after the electrostatic contrast reaches a position of 100 volts or higher. In other words, in the case of the magnetizable black toner particles, an image development is possible when the electrostatic contrast is of a value equal to or higher than about 100 volts, whereas in the case of the non-magnetizable red toner particles the image development is possible at the electrostatic contrast lower than that.

Figure 4:
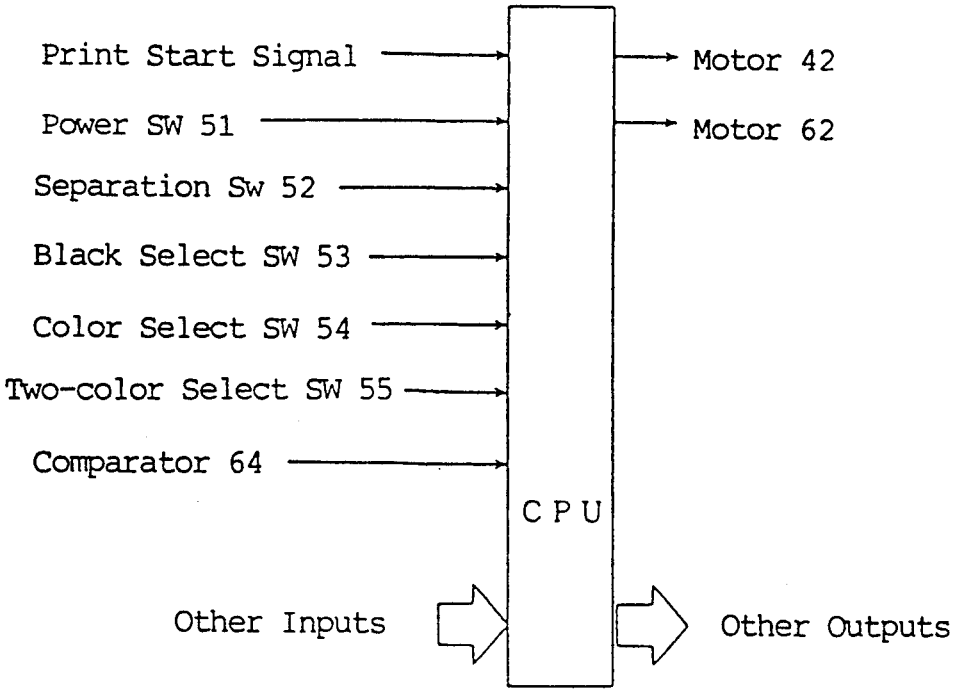
FIG. 4 is a diagram showing a central control device used in an image forming apparatus.

FIG. 4 illustrates a portion of a control circuit employed in the image forming apparatus embodying the present invention. A central control device CPU of a microcomputer has a plurality of input ports which are electrically connected respectively with an external input device capable of providing a PRINT START signal when a print is desired to be made; a power switch 51; a separation switch 52 for actuating a separation mode during which the first toner material is separated and recovered from the first toner material; a black selection switch 53 for selecting a black print mode during which a mono-tone image in black color is formed; a color selection switch 54 for selecting a color print mode during which a mono-tone image in red color is formed; a two-color selection switch 55 for selecting a two-color print mode during which a two-color image in black and red color is formed; and the comparator 64. This central control device CPU also has a plurality of output ports from which remote signals for driving the motors 42 and 62 emerge respectively. Although not shown, remote signals for driving the photoreceptor drum 1, the chargers 2, 5, 7 and 8, the developing units 4 and 6 and the eraser 10 are generated also from the output ports of the central control device CPU.

A two-color image forming process executed by the printer of the above described construction will now be described.

Assuming that the photoreceptor drum 1 is driven to rotate in one direction counterclockwise as viewed in FIG. 1, the photoreceptor drum 1 moves past the plurality of the processing stations. At the first charging station, an outer peripheral surface of the photoreceptor drum 1 is uniformly electrostatically charged by the first electrostatic charger 2. Then, at the first exposure station, the imagewise laser beams 34 emitted from the first laser head 32 in correspondence with a red-color image and subsequently reflected from the scanner 31 is projected onto the photoreceptor drum 1 to form thereon a first electrostatic latent image which is subsequently developed by the first developing unit 4 at the first developing station into a red toner image. During the counterclockwise rotation of the photoreceptor drum 1, the outer peripheral surface of the photoreceptor drum 1 is again electrostatically charged uniformly by the second electrostatic charger 5 and, then at the second exposure station the imagewise laser beams 35 emitted from the second laser head 33 in correspondence with a black-color image and subsequently reflected from the scanner 31 is projected onto the photoreceptor drum 1 to form thereon a second electrostatic latent image. This second electrostatic latent image is also developed by the second developing unit 6 at the second developing station into a black toner image.

On the other hand, one of the recording papers in the paper supply cassette 11 is fed by the paper supply roller 12 towards the timing roller pair 13 at which the recording paper drawn outwardly from the cassette 11 is held still so that it can be fed to the transfer station at a timing synchronized with the arrival of the toner images on the photoreceptor drum 1 at that transfer station. The black- and red-color toner images carried by the photoreceptor drum 1 can be transferred onto the recording paper at the transfer station by the effect of a discharge accomplished by the transfer charger 7. The recording paper having the toner images transferred thereto at the transfer station is subsequently separated by the separation charger 8 from the peripheral surface of the photoreceptor drum 1 and is then conveyed through the conveyor belt 14 towards the fixing unit 15 at which the toner images are permanently fixed on the recording paper thereby to complete an image bearing print. This image bearing print is then ejected by the delivery roller pair 16 onto the print delivery tray 17. On the other hand, subsequent to the separation of the recording paper from the photoreceptor drum 1, and during the continued rotation of the photoreceptor drum 1, the toner particles and the electrostatic charge both remaining on the photoreceptor drum 1 are successively removed at the cleaning station by the cleaning unit 9 and the eraser 10, respectively, in readiness for the next succeeding cycle of operation.

Potentials employed during the above described two-color image forming process are chosen as follows:

| | |
|---|---|
| a) Potential on the photoreceptor drum surface imparted by the first charger 2 | −600 volts |
| b) Potential of an exposed portion after the exposure at the first exposure station | −50 volts |
| c) Developing bias voltage in the first developing unit 4 | −450 volts |
| d) Potential on the photoreceptor drum surface imparted by the second charger 5 | −700 volts |
| e) Potential of an exposed portion after the exposure at the second exposure station | −60 volts |
| f) Developing bias voltage in the second developing unit 6 | −550 volts |

It is to be noted that the electrostatic contrast used during the development with the black toner material is 490 volts (i.e., 550−60=490) whereas the electrostatic contrast used during the development with the red toner material is 400 volts (i.e., 450−50=400). The reason for the employment of the higher electrostatic contrast during the development with the black toner material than that during the development with the red toner material is because the black toner material is magnetizable. In other words, since magnetic forces of constraint oriented towards the developing roll 6a act on the magnetizable black toner material, the use of the higher electrostatic contrast is effective to enhance an electrostatic force of attraction of the black toner material towards the photoreceptor drum 1, thereby to secure a proper image density.

During the execution of the previously discussed two-color image forming process, magnetic brush bristles of the second developing unit 6 contact the red toner material deposited on the photoreceptor drum 1. Therefore, it may occur that the red toner material deposited on the photoreceptor drum 1 are removed from the photoreceptor drum 1 in contact with the magnetic brush bristles and progressively enter the second developing unit 6 to mix with the second developing material. However, in the practice of the present invention, since both of the red toner material and the black toner material are of a type capable of being charged negative relative to the carrier particles, the red toner material and the black toner material, when the both are contacted with each other as a result of a mixing of the former with the latter will not substantially be charged electrostatically, but are charged to a negative potential relative to the carrier material.

Therefore, there is no possibility that, consequent upon a reversion in charge polarity of the red toner material mixing into the second developing material, the red toner particles may be dusted. Hereinafter, conditions and operations for selecting the separation mode during which the red toner material mixing into the second developing material is separated and recovered from the second developing material will be discussed.

Under the separation mode, the photoreceptor drum 1, the first electrostatic charger 2 and the second developing unit 6 are driven, but all of the first developing unit 4, the second electrostatic charger 5, the transfer charger 7, the separation charger 8, the eraser 10 and the optical system 3 are held in respective inoperative positions. At this time, the following potentials are employed:

| | |
|---|---|
| a) Potential on the photoreceptor drum surface imparted by the first charger 2 | −600 volts |
| b) Developing bias voltage in the second developing unit 6 | −670 volts |

Accordingly, during the execution of the separation mode, the outer peripheral surface of the photoreceptor drum 1 is uniformly charged by the first electrostatic charger 2 to −600 volts before it reaches the second developing station. Since the second developing unit 6 is then applied with the bias voltage of −670 volts, an electrostatic contrast corresponding to the difference of 70 volts between the potential on the photoreceptor drum surface and the bias voltage is generated. Based on this electrostatic contrast, the red toner particles entering the second developing unit 6 are attracted onto the photoreceptor drum 1. On the other hand, the electrostatic contrast of 70 volts is insufficient for the magnetizable black toner particles to be developed as can readily be understood from the characteristic curve shown in FIG. 3 and, therefore, as a rule, the black toner particles will not be attracted onto the photoreceptor drum 1. Thus, the red toner particles mixing into the second developing material are selectively separated from the second developing material to deposit on the photoreceptor drum 1 and are subsequently recovered by the cleaning unit 9.

As hereinabove discussed, in principle, only the red toner material mixing into the second developing unit 6 can be selectively separated and recovered without containing the black toner particles. However, in practice, the red toner material recovered contains a quantity of the black toner material. Particularly where the amount of the red toner material mixing into the second developing material is relatively large, where the separation mode is desired to be accomplished in a relatively short length of time, and where a recovery of the red toner material is desired to be carried out by depositing the red toner material on a specific region of the photoreceptor drum 1, the quantity of the black toner material recovered together with the red toner material tends to be large. Accordingly, the image forming apparatus embodying the present invention is provided with a unique design that enables a user or operator of the image forming apparatus to select the separation mode at his or her option, e.g., when the user determines it necessary to perform a recovery of the red toner material from the second developing material, thereby to minimize a waste of the black toner material. This unique design will now be described with particular reference to FIGS. 5 to 8.

Figure 5:
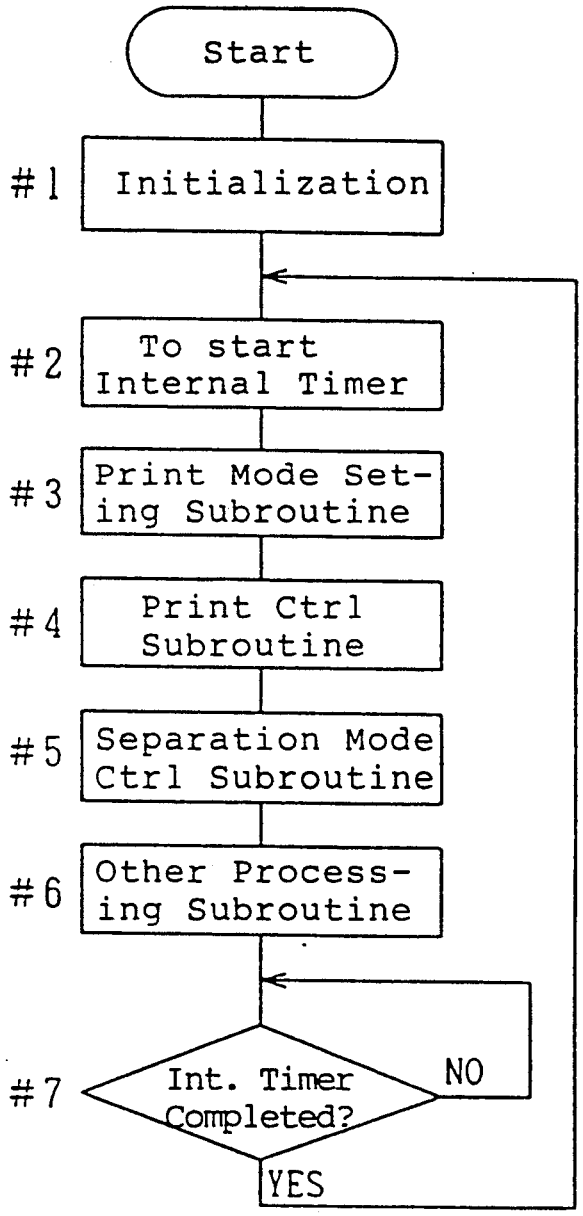
FIG. 5 is a flowchart showing a main routine.

Referring now to FIG. 5 illustrating a main routine of a printer control, the microcomputer is initialized at step #1 when the power switch 51 is turned on. Then at step #2, an internal timer is started and, during an execution of a flow from step #3 to step #6, a print mode setting subroutine, a printer control subroutine, a separation mode control subroutine and other processing subroutines are sequentially executed, the details of each of these subroutines being described later. It is, however, to be noted that the other processing routines executed at step #6 do not constitute subject matter of the present invention and, therefore, are not described for the sake of brevity. At step #7, a decision is made to determine if the internal timer has terminated and, if it indicates that the internal timer has counted up, the program flow return to step #2 to repeat the flow.

Figure 6:
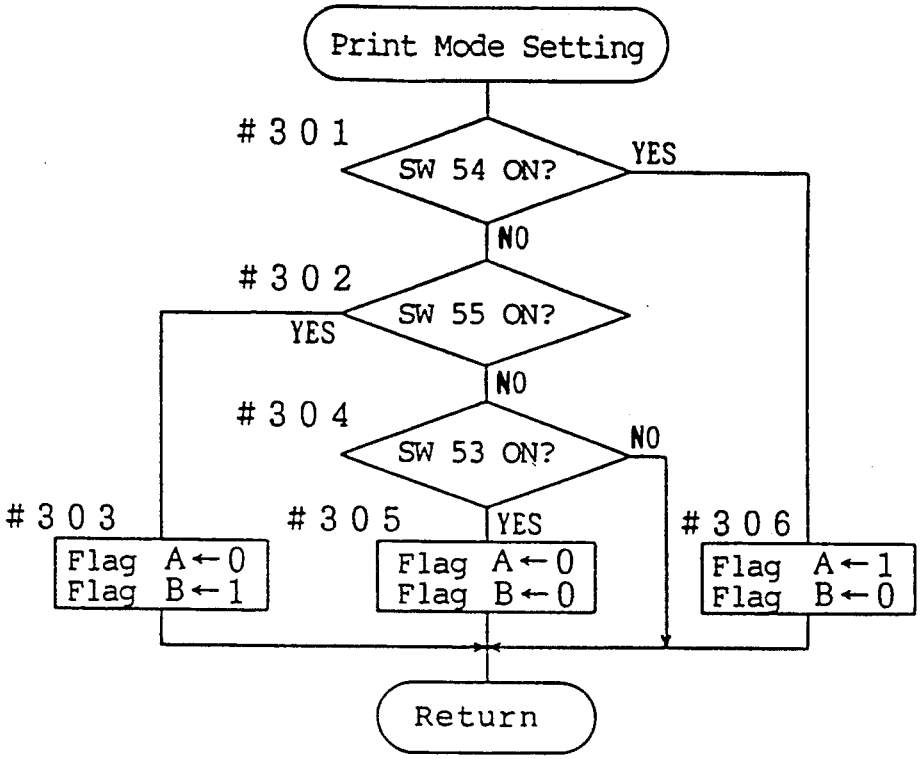
FIG. 6 is a flowchart showing a print mode setting subroutine.

The details of the print mode setting subroutine executed at step #3 of the main flow of FIG. 5 are shown in FIG. 6. During an execution of a flow from step #301 to step #303, a decision is made to determine if the color selection switch 54, the two-color selection switch 55 and the black selection switch 53 have been turned on, respectively. Where the two-color selection switch 55 has been turned on, the program flow goes from step #302 to step #303 at which flags A and B are set to "0" and "1", respectively. Where the black selection switch 53 has been turned on, the program flow goes from step #304 to step #305 at which both of the flags A and B are set to "0". Where the color selection switch 54 has been turned on, the program flow goes from step #301 to step #306 at which the flags A and B are set to "1" and "0", respectively. On the other hand, if none of the switches 53, 54 and 55 is turned on, the program flow returns to the main flow of FIG. 5. Thus, it will readily be seen that one of the following combinations of the respective status of the flags A and B is determinative of a particular print mode selected.

| | Print Modes | | |
|---|---|---|---|
| | Black | Red | two-color |
| Flag A | 0 | 1 | 0 |
| Flag B | 0 | 0 | 1 |

Figure 7:
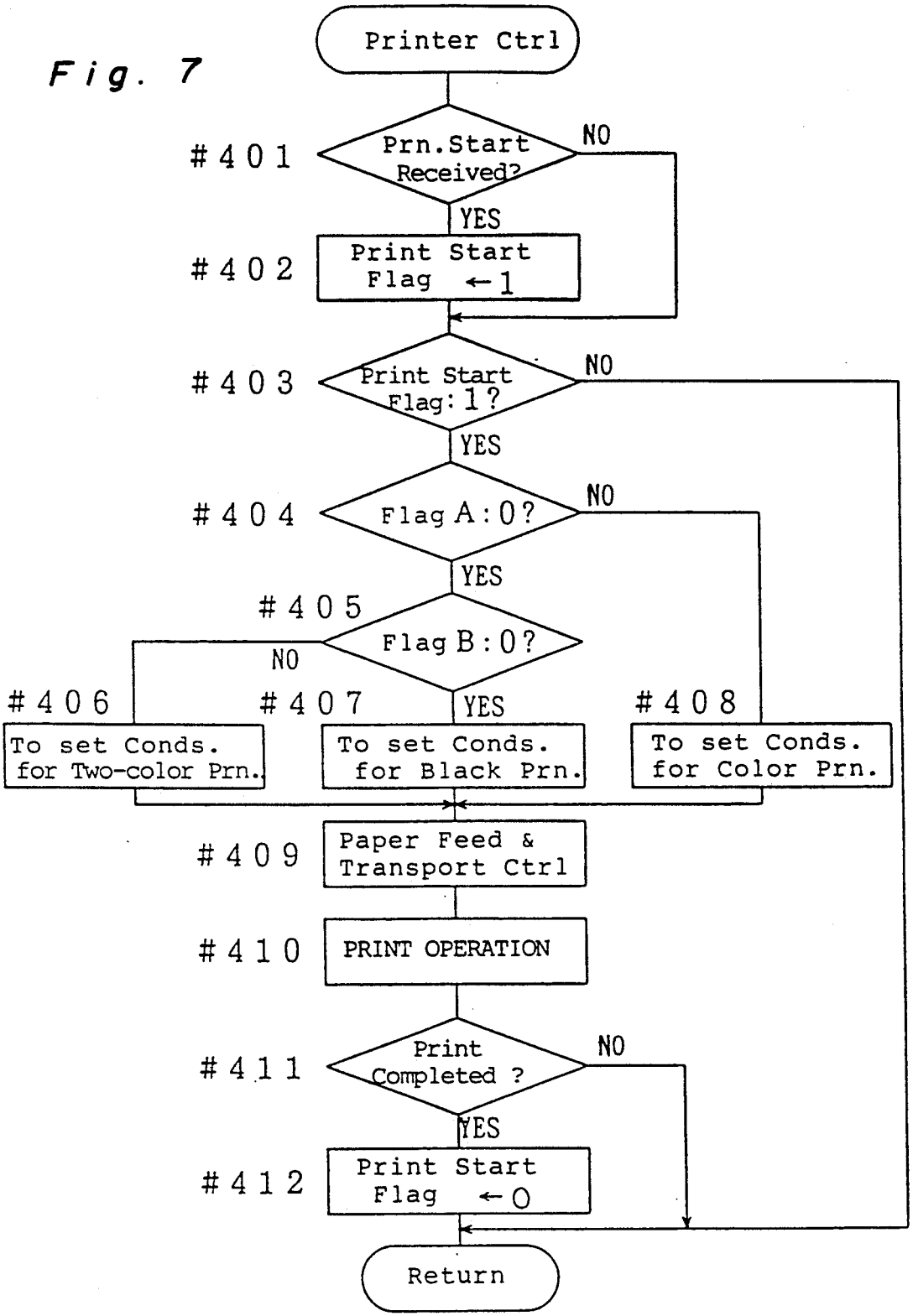
FIG. 7 is a flowchart showing a printer control subroutine.

Referring now to FIG. 7, there is shown the details of the printer control subroutine. Subsequent to a start of this printer control subroutine, a decision is made at step #401 to determine if the PRINT START signal has been received by the central control unit CPU. If the central control unit CPU has received the PRINT START signal, a Print Start flag is set to "1" at step #402. The PRINT START signal referred to above is inputted from an input device such as, for example, a computer, to which the printer is connected. When the Print Start flag is set to "1" at step #402, conditions appropriate to the selected print mode are subsequently set as will now be described.

At step #403, a decision is made to determine if the Print Start flag has been set to "1" and, if it indicates that the Print Start flag has been set to "1", a flow from step #404 to step #412 is executed. However, if the decision at step #403 indicates that the Print Start flag is set to a value other than "1", that is, "0", it means that no PRINT START signal is inputted and, therefore, the program flow returns to the main flow of FIG. 5.

Assuming that the Print Start flag has been set to "1", respective status of flags A and B are examined at successive steps #404 and #405 to determine which one of the print modes is selected. Then, the developing bias voltage and electric currents to be supplied to the various chargers are determined to respective values appropriate to the selected one of the print modes at step #406 if the two-color print mode has been selected, at step #407 if the black print mode has been selected, or at step #408 if the color print mode has been selected.

Thereafter, at step #409 various devices forming a paper supply and transport system are set in a printing condition appropriate to the selected print mode, and the program flow subsequently goes to a "PRINT OPERATION" step #410 at which the optical system, the chargers, the developing units, the eraser and other operative units disposed around the photoreceptor drum 1 are set in a printing condition appropriate to the selected print mode. Following step #410, a decision is made at step #411 to determine if the printing operation has completed to provide an image bearing print. In the event that the printing operation has not yet completed and is still in progress, the program flow returns to the main flow of FIG. 5, but in the event that the printing operation has completed, the program flow goes to step #412 at which the Print Start flag is reset to "0" and, at the same time, all of the photoreceptor drum, the various chargers, the developing units and other devices around the photoreceptor drum are brought into the inoperative position, thereby completing one cycle of the printing operation.

Figure 8:
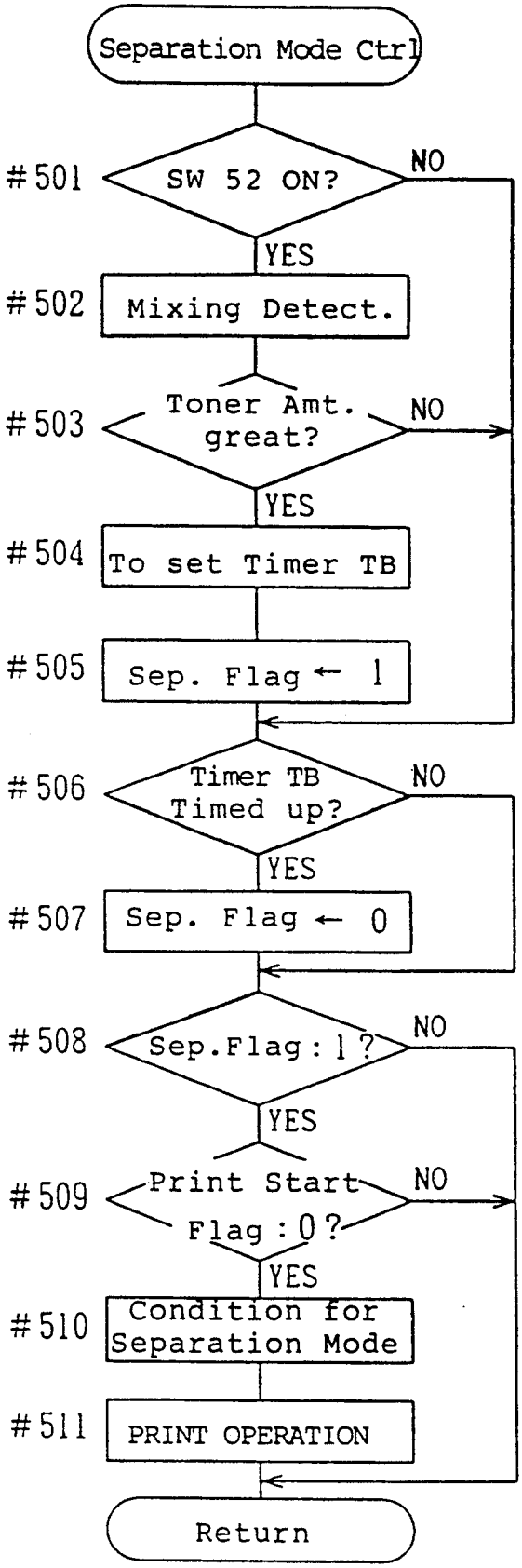
FIG. 8 is a flowchart showing a separation mode control subroutine.

The separation mode control subroutine, i.e., the subroutine for the control under the separation mode, is shown in FIG. 8. Subsequent to the start of the separation mode control subroutine, a decision is made at step #501 to determine if the separation switch 52 has been turned on. If the separation switch 52 has been turned on, a detection of the amount of the red toner material mixing into the second developing unit 6 is made at step #502. As hereinbefore described, the amount of the red toner material mixing into the second developing unit 6 is detected by the photoelectric sensor 63. Then, at step #503, a decision is made to determine if the detected amount of the red toner material mixing into the second developing unit 6 is greater than a maximum allowable limit corresponding to the maximum allowable color mixing degree. This is accomplished by the comparator 64 which generates, as its output signal 65, a high level signal or a low level signal if it is greater or smaller than the maximum allowable limit.

Should a result of decision at step #503 indicate that the amount of the red toner material mixing into the second developing unit 6 is greater than the maximum allowable limit, the program flow goes to step #504 at which a timer TB determinative of a recovery time, that is, the length of time during which the recovery of the red toner material from the second developing unit 6 is to be carried out, is set. Then at step #505, a separation flag is set to "1", and the separation mode is subsequently executed by determining that the separation flag has been set to "1".

During an execution of the flow of steps #506 and #507, the separation mode is terminated. Specifically, at step #506 a decision is made to determine if the timer TB determinative of the length of time during which the separation mode is carried out has timed up, and if it has timed up, step #507 takes place to set the separation flag to "0" and, also, to bring all of the photoreceptor drum 1, the second developing unit 6 and the first electrostatic charger 2 to an inoperative position, thereby completing the separation mode.

Thereafter, a decision is made at step #508 to determine if the separation flag is "1", that is, if the separation mode is in progress. If step #508 indicates that the separation mode is in progress, another decision is made at step #509 to determine if the Print Start flag is set to "0". Should step #509 indicate that the Print Start flag is not set to "0", that is, any one of the print modes is not selected, the program flow goes to step #510 at which the potentials appropriate to the separation mode are set, followed by step #510 at which the various devices disposed around the photoreceptor drum and associated with the separation mode are set in a condition required to execute the separation mode. On the other hand, if the Print Start flag is set to "1", that is, if one of the print modes is executed, the separation mode is disabled and, therefore, there is no possibility that any one of the print modes and the separation mode take place at the same time.

As hereinbefore described, according to the first preferred embodiment of the present invention, the illustrated printer is so designed and so operable that, only when the separation switch 52 has been depressed and, at the same time, the amount of the red toner material mixing into the second developing unit is detected to be greater than the maximum allowable limit, the separation mode is carried out. Since no separation mode is called for so long as it is not required, any possible waste of the toner material can advantageously be minimized.

In describing the foregoing embodiment of the present invention, the second developing unit 6 has been described and shown as having the photoelectric sensor assembly to detect the mixing amount of the toner material. However, arrangement may be made that, while a patterned image is formed on the photoreceptor drum 1 by the utilization of only the second developing unit 6, the mixing amount of the toner material can be detected by detecting the density of the patterned image on the photoreceptor drum.

Also, while it has been described that the separation mode is executed only when the mixing amount of the toner material detected by the photoelectric sensor assembly is greater than the maximum allowable limit, the separation mode can be executed unconditionally if the separation switch is turned on. In other words, even though the photoelectric sensor malfunctions or has its sensitivity lowered, the separation mode can be executed if the user examining the resultant image bearing print determines that the separation mode should be carried out. Therefore, so long as the user does not question the mixing of the toner material of different colors, the toner material will not be consumed unnecessarily.

The separation switch 52 has been used in the foregoing embodiment of the present invention to execute the separation mode when it is turned on. However, the power switch 51 may be designed to concurrently serve as a separation switch so that, simultaneously with a start of the printer with the power switch 51 turned on, the separation mode can be set in a condition ready to be executed. According to this alternative method, since the separation mode can be executed simultaneously with the start of the printer, not only can image bearing prints showing no mixed color be obtained from the beginning, but also the separation mode will not be executed while the printer is in operation, making it possible to minimize any possible waste of the toner material.

Although the separation switch 52 has been described as provided in the printer, it may be provided in the input device such as the microcomputer connected with the printer.

SECOND EMBODIMENT (FIGS. 1 TO 3, 5, 6 AND 9 TO 12)

According to the foregoing embodiment, the separation mode has been described and shown as selected at the will of the user of the image forming apparatus when he or she determines, after having inspected the resultant image bearing prints, that the separation mode should be executed to minimize the color mixing.

However, the mixing of the first toner material into the second developing unit is considerable where the first and second developing units are driven simultaneously. In other words, the amount of the first toner material mixing into the second developing material may be said to be relatively small when either one of the first and second developing units is driven into operation and to be relatively great when a two-color printing is performed. Considering this situation, the amount of the first toner material mixing into the second developing unit may be estimated by counting the number of the two-color image bearing prints made by the image forming apparatus and, therefore, it may be contemplated to execute the separation mode when the number of the two-color image bearing prints attains a predetermined value. This system will now be described in connection with a second preferred embodiment of the present invention with particular reference to FIGS. 1 to 3, 5, 6 and 9 to 12.

Figure 9:
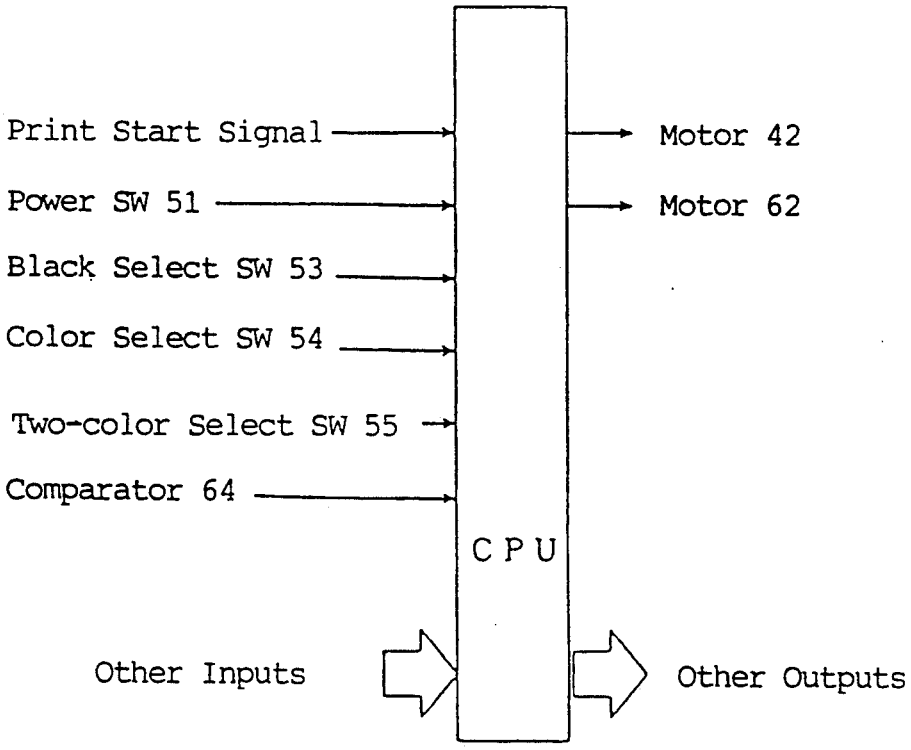
FIG. 9 is a diagram showing the central control device used in the image forming apparatus according to a second preferred embodiment of the present invention.
Figure 10:
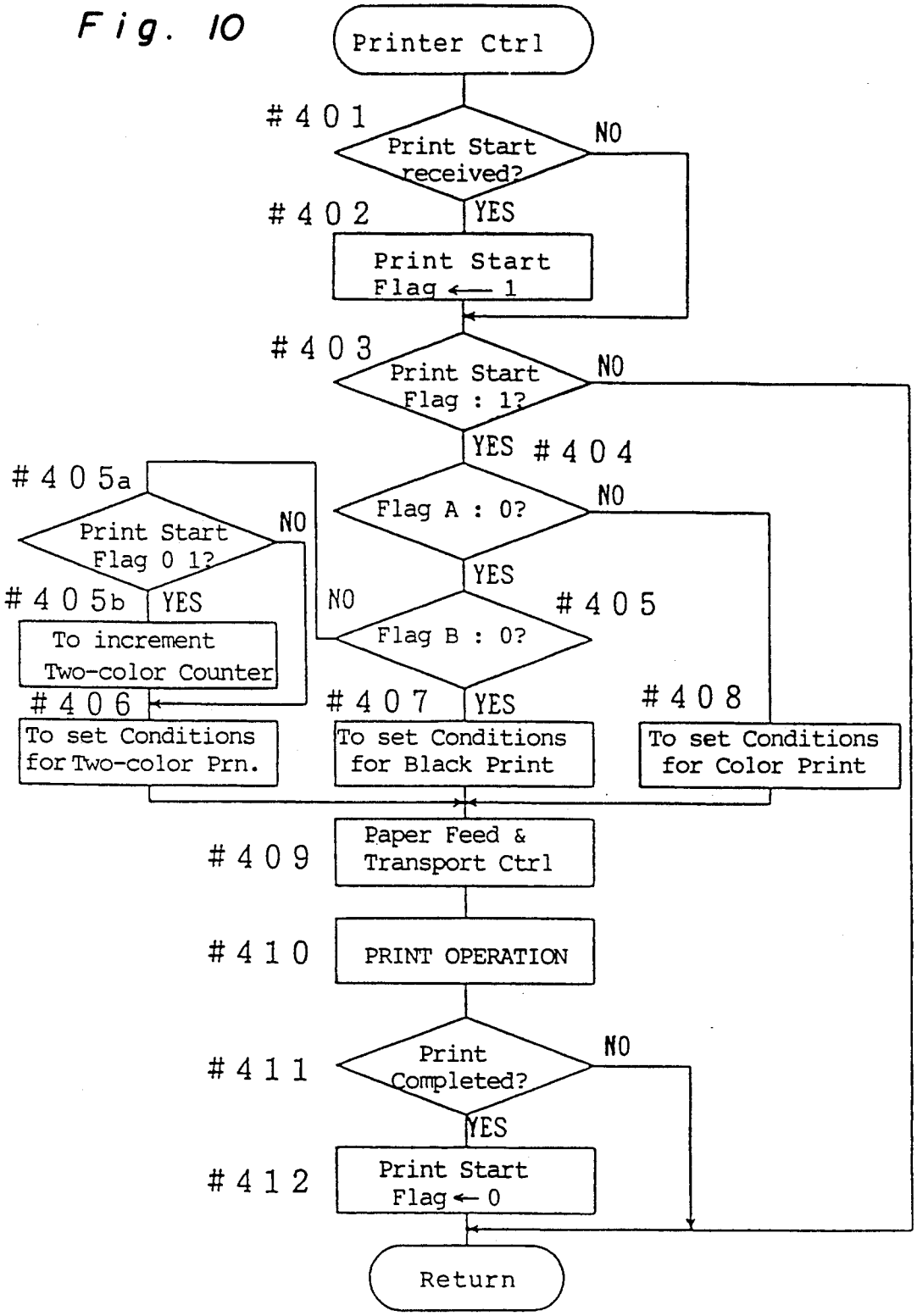
FIG. 10 is a flowchart showing the printer control subroutine executed in the image forming apparatus according to the second embodiment of the present invention.
Figure 11:
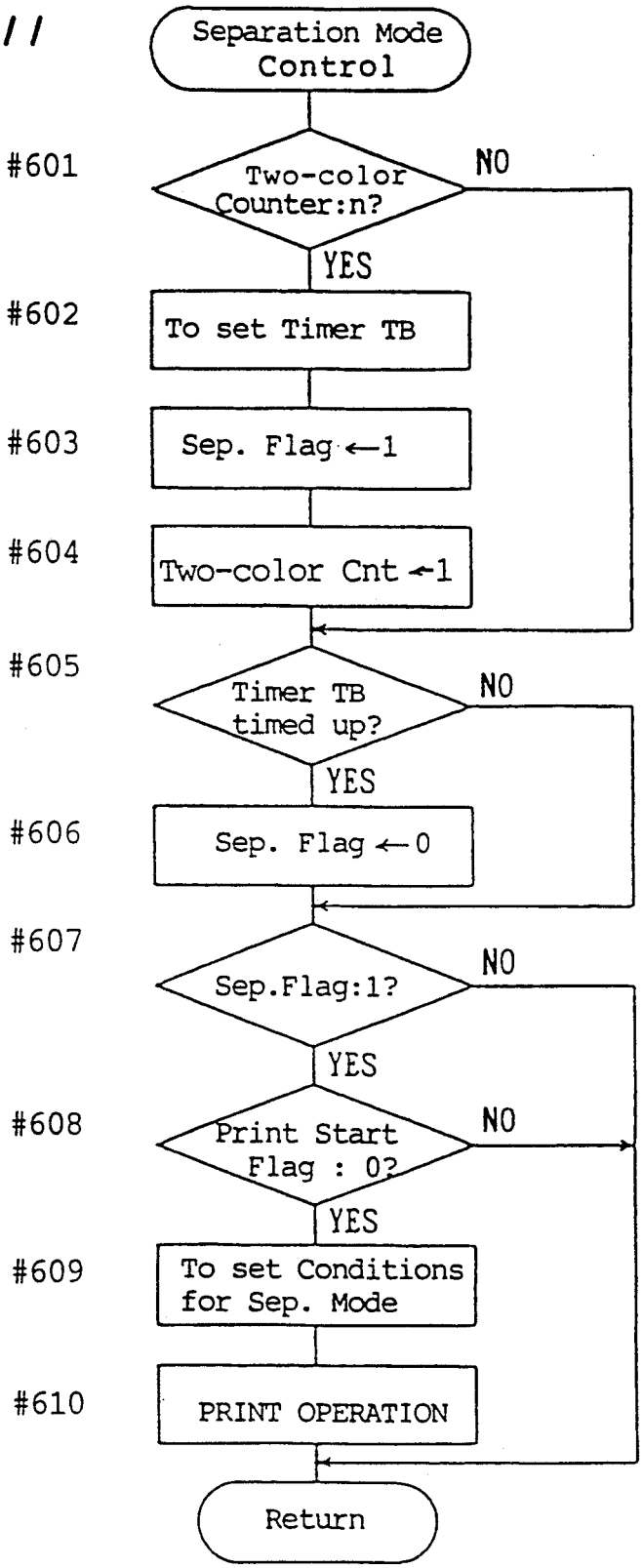
FIG. 11 is a flowchart showing the separation mode control subroutine executed in the image forming apparatus according to the second embodiment of the present invention.
Figure 12:
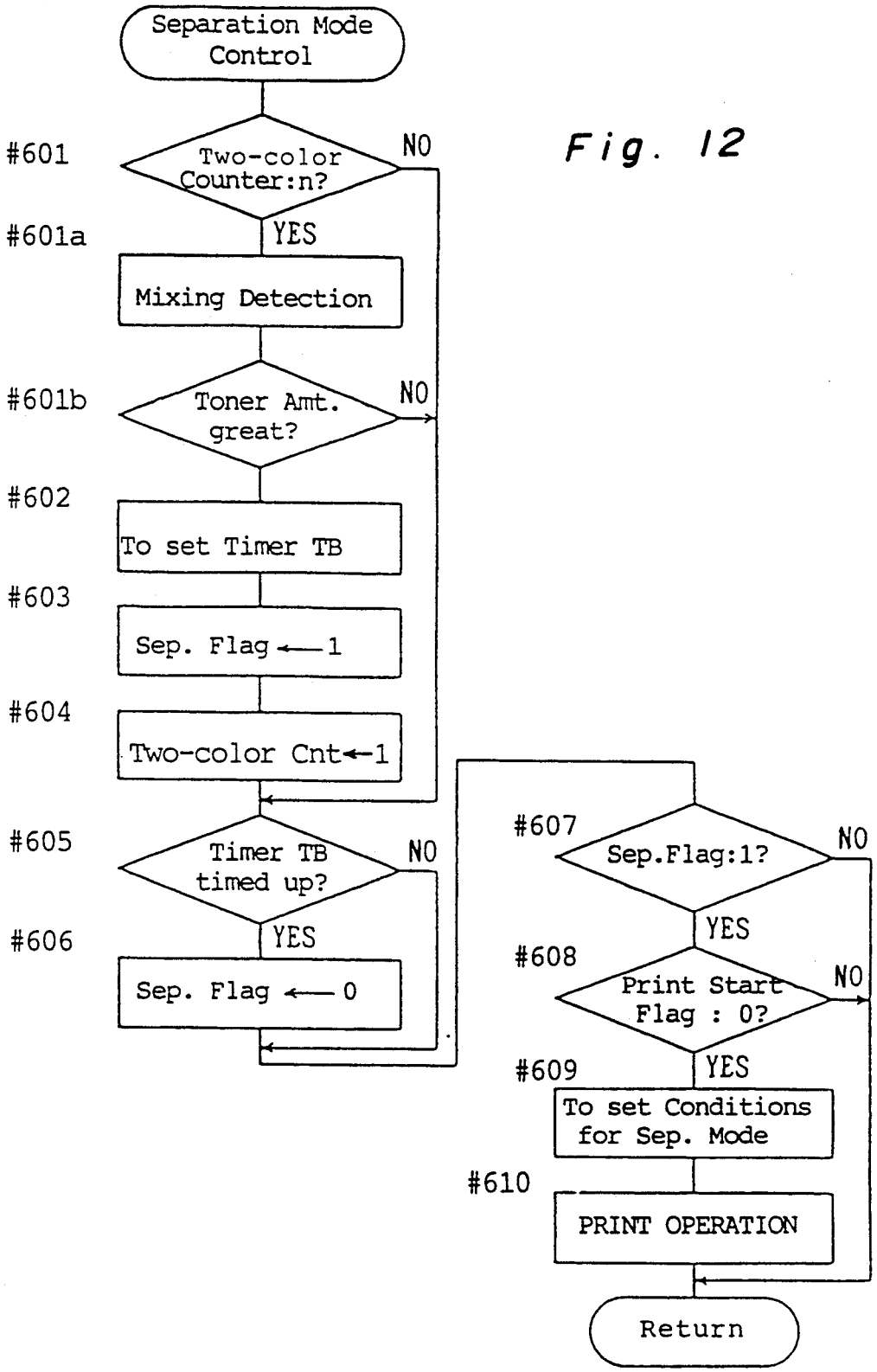
FIG. 12 illustrates a modified form of the separation mode control subroutine of FIG. 11.

The image forming apparatus according to this embodiment is substantially identical with that shown and described in connection with the foregoing embodiment, except that, as best shown in FIG. 9, no separation switch such as identified by 52 in FIG. 4 is connected with the central control unit CPU. In this image forming apparatus, instead of the use of the separation switch such as used in the foregoing embodiment, a means is provided for detecting the number of the resultant two-color image bearing prints and for activating the photoelectric sensor assembly when the number of the resultant two-color image bearing prints exceeds a predetermined value thereby to initiate the separation mode. For this purpose, as will subsequently be described, the printer control subroutine and the separation mode control subroutine are modified as shown in FIG. 10 and FIG. 11 or 12, respectively.

Referring now to FIG. 7, there is shown the details of the printer control subroutine. Subsequent to a start of this printer control subroutine, a decision is made at step #401 to determine if the PRINT START signal has been received by the central control unit CPU. If the central control unit CPU has received the PRINT START signal, a Print Start flag is set to "1" at step #402. The PRINT START signal referred to above is inputted from an input device such as, for example, a computer, to which the printer is connected. When the Print Start flag is set to "1" at step #402, conditions appropriate to the selected print mode are subsequently set as will now be described.

At step #403, a decision is made to determine if the Print Start flag has been set to "1" and, if it indicates that the Print Start flag has been set to "1", a flow from step #404 to step #412 is executed. However, if the decision at step #403 indicates that the Print Start flag is set to a value other than "1", that is, "0", it means that no PRINT START signal is inputted and, therefore, the program flow returns to the main flow of FIG. 5.

Assuming that the Print Start flag has been set to "1", respective status of flags A and B are examined at successive steps #404 and #405 to determine which one of the print modes is selected. Then, the developing bias voltage and electric currents to be supplied to the various chargers are determined to respective values appropriate to the selected one of the print modes at step #406 if the two-color print mode has been selected, at step #407 if the black print mode has been selected, or at step #408 if the color print mode has been selected.

However, before the program flow from the decision step #405 goes to step #406, a decision is made at step **#405*a* to determine if the Print Start flag has been changed from "0" to "1" within the length of time set in the internal timer. In the event that the Print Start flag has been changed from "0" to "1" within the specified length of time, a two-color counter is incremented by 1 at step #405*b*, followed by step #406 to establish the conditions appropriate to the selected print mode, that is, the two-color print mode. If the Print Start flag has not been changed within the specified length of time, the program flow goes from step #405*a* to step #406**.

Thereafter, at step #409 various devices forming a paper supply and transport system are set in a printing condition appropriate to the selected print mode, and the program flow subsequently goes to a "PRINT OPERATION" step #410 at which the optical system, the chargers, the developing units, the eraser and other operative units disposed around the photoreceptor drum 1 are set in a printing condition appropriate to the selected print mode. Following step #410, a decision is made at step #411 to determine if the printing operation has completed to provide an image bearing print. In the event that the printing operation has not yet completed and is still in progress, the program flow returns to the main flow of FIG. 5, but in the event that the printing operation has completed, the program flow goes to step #412 at which the Print Start flag is reset to "0" and, at the same time, all of the photoreceptor drum, the various chargers, the developing units and other devices around the photoreceptor drum are brought into the inoperative position, thereby completing one cycle of the printing operation.

The separation mode control subroutine, i.e., the subroutine for the control under the separation mode, employed in the practice of the second embodiment of the present invention is shown in FIG. 11.

Referring now to FIG. 11, subsequent to the start of the separation mode control subroutine, a decision is made at step #601 to determine if the count of a two-color counter is n, that is, if the number of the resultant two-color image bearing prints has attained a predetermined value n. The count n of the two-color counter is defined as a maximum acceptable number of the two-color image bearing prints formed by repeatedly performing a number of the two-color image forming cycles until the last copy of the two-color image bearing prints comes to show a noticeable mixed color, and can be empirically determined. In other words, after the two-color image forming process is performed repeatedly to produce the n number of the resultant two-color image bearing prints, a color mixed against the background of a black image will come to be noticeable.

Therefore, if the result of decision at step #601 indicates that the count of the two-color counter has reached n, the timer TB is set at step #602 and is, after the separation flag has subsequently been set to "1" at step #603 to execute the separation mode, reset to "0" at step #604. It is to be noted that the timer TB is used to determine the length of time during which the first toner material is recovered from the second developing unit 6, that is, during which the separation mode takes place.

During an execution of the flow of steps #605 and #606, the separation mode is terminated. Specifically, at step #605 a decision is made to determine if the timer TB has timed up, and if it has timed up, step #606 takes place to set the separation flag to "0" thereby to terminate the separation mode. Thereafter, at step #608 another decision is made to determine if the separation flag is "1", that is, if the separation mode is in progress. If step #608 indicates that the separation mode is in progress, another decision is made at step #609 to determine if the Print Start flag is set to "0". Should step #609 indicate that the Print Start flag is not set to "0", that is, any one of the print modes is not selected, the program flow goes to step #609 at which the potentials appropriate to the separation mode are set, followed by step #610 at which the various devices disposed around the photoreceptor drum and associated with the separation mode are set in a condition required to execute the separation mode. On the other hand, if the Print Start flag is set to "1", that is, if one of the print modes is executed, the separation mode is disabled and, therefore, there is no possibility that any one of the print modes and the separation mode take place at the same time.

As hereinbefore described, according to the second preferred embodiment of the present invention, the illustrated printer is so designed and so operable that, only when the count of the counter used to count the number of the resultant two-color image bearing prints has attained the predetermined value n, the separation mode can be executed to separate and recover the first toner material from the second developing unit 6. By the execution of the separation mode, the red toner material mixing into the second developing unit 6 can be efficiently separated and recovered to minimize any possible waste of the black toner material.

In describing the foregoing embodiment of the present invention, the separation mode has been shown and described as executed when the count of the two-color counter has attained the predetermined value n. However, the separation mode control subroutine shown in FIG. 11 may be modified as shown in FIG. 12. The subroutine of FIG. 12 differs from that of FIG. 11 in that extra steps #601*a* and #601*b* are inserted between steps #601 and #602.

Referring to FIG. 12, if step #501 indicates that the count of the two-color counter has attained the predetermined value n, the amount of the red toner material mixing into the second developing unit 6 is detected at step #601*a*. Then at step #601*b*, a decision is made to determine if the amount of the red toner material mixing into the second developing unit 6 is greater than the maximum allowable limit. Only when the amount of the red toner material mixing into the second developing unit 6 is determined to be greater than the maximum allowable limit, the timer TB is set at step #602, but if it is smaller than the maximum allowable limit, the execution of the separation mode is suspended.

According to the modified subroutine shown in FIG. 12, the timing at which the separation mode should be executed can be properly determined thereby to further minimize the waste of the second toner material. As hereinbefore described in connection with the first preferred embodiment of the present invention, the amount of the red toner mixing into the second developing unit 6 can be detected by the utilization of the photoelectric sensor assembly comprising the photoelectric sensor 63*a* and the associated comparator 64. As an alternative to the use of the photoelectric sensor assembly, arrangement may be made to detect the amount of the red toner material mixing into the second developing unit 6 by forming a patterned image on the outer peripheral surface of the photoreceptor drum 1 and then by detecting the density of the patterned image carried by the photoreceptor drum.

Thus, according to the second embodiment of the present invention shown in and described with reference to FIGS. 1 to 3, 5, 6 and 9 to 12, the separation and recovery of the first toner material from the second developing material is carried out only when the number of the two-color image bearing prints has attained the predetermined value. In other words, in dependence on the amount of the first toner material mixing into the second developing unit which may correspond to the number of the resultant two-color image bearing prints, the first toner material is separated and recovered from the second developing unit. Accordingly, not only can any possible waste of the second toner material be minimized, but also the toner material as a whole can be effectively utilized.

In addition, the waste of the second toner material can further be minimized if the amount of the first toner material mixing into the second developing material is detected at the time the number of the resultant two-color image bearing prints has attained the predetermined value.

THIRD EMBODIMENT (FIGS. 1 TO 4, 6, 7 AND 13 TO 15)

While the two-color image forming apparatus according to any one of the foregoing embodiments of the present invention works satisfactorily, a complete separation of the first toner material from the second developing unit is not possible and, in practice, the first toner material recovered has been found containing a quantity of the second toner material. Specifically, as hereinabove discussed, the first or red toner material recovered contains a quantity of the second or black toner material. This tends to occur particularly where the amount of the red toner material mixing into the second developing material is relatively large, where the separation mode is accomplished in a relatively short length of time, and where a recovery of the red or first toner material from the second developing unit is carried out by depositing the second toner material on a specific region of the photoreceptor drum 1. This means that, while the present invention makes it possible to minimize the waste of the second toner material hitherto encountered, the quantity of the second toner material within the second developing unit is prone to decrease with a repeated execution of the separation mode over a number of cycles. Accordingly, the necessity may arise to replenish the second toner material to compensate for the reduction in quantity of the second toner material within the second developing unit.

In view of the foregoing, the image forming apparatus according to the first preferred embodiment of the present invention is modified so as to have a capable of executing a toner replenishment mode during which the second toner material can be replenished into the second developing unit 6 to compensate substantially for the reduction in quantity of the second toner material. This modified image forming apparatus will now be described with particular reference to FIGS. 1 to 4, 6, 7 and 13 to 15.

Figure 13:
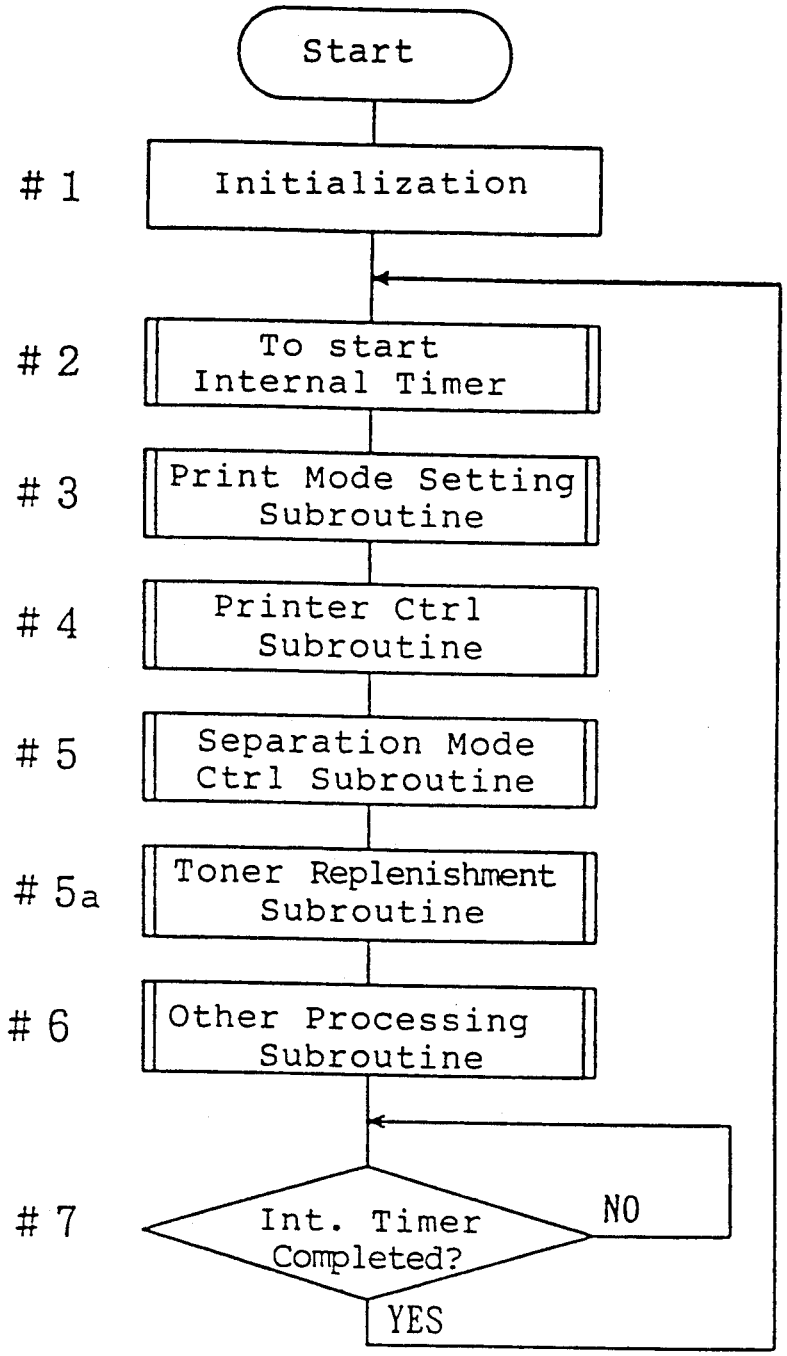
FIG. 13 is a flowchart showing the main routine executed in the image forming apparatus according to a third preferred embodiment of the present invention.
Figure 14:
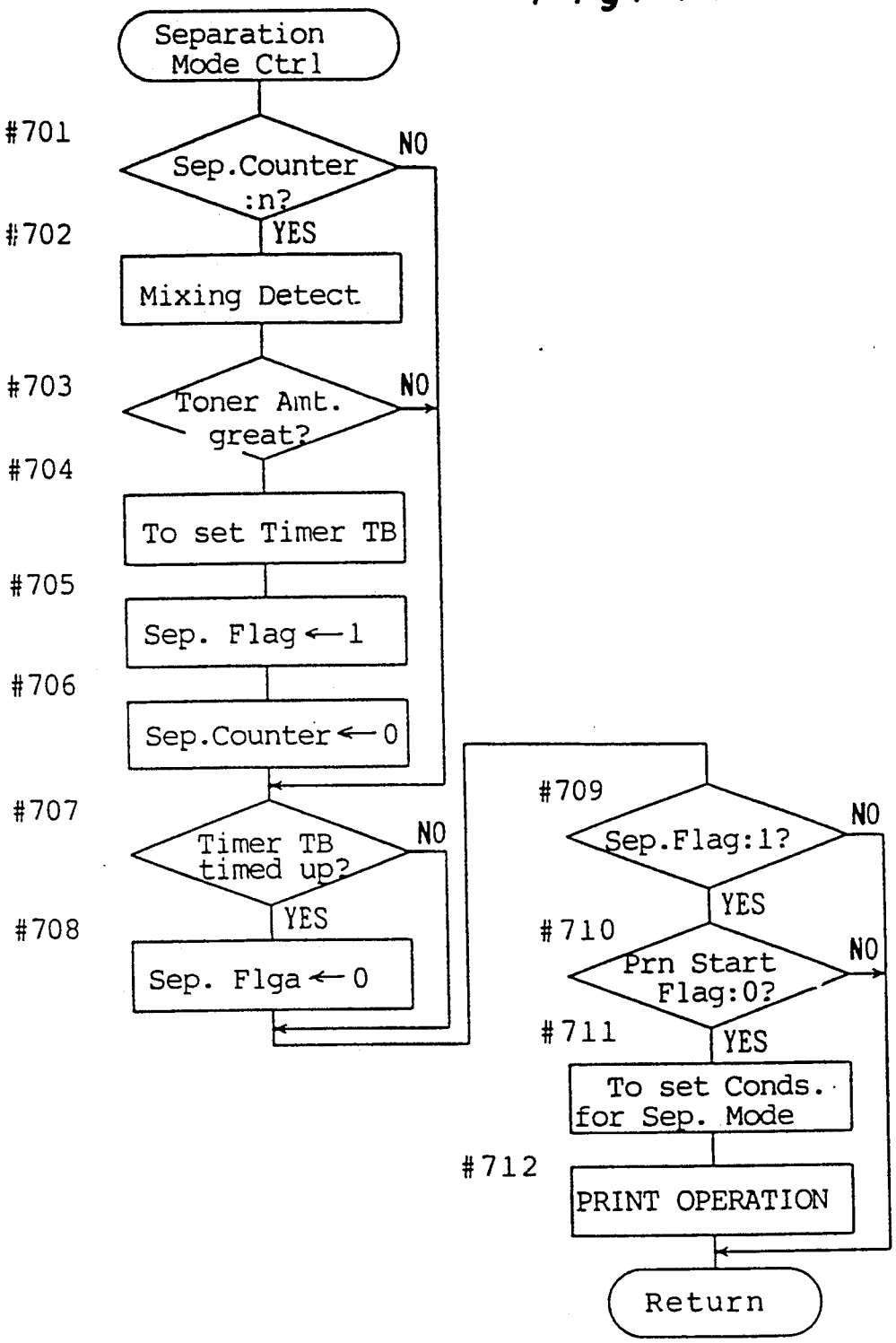
FIG. 14 is a flowchart showing the separation mode control subroutine executed in the image forming apparatus according to the third embodiment of the present invention.
Figure 15:
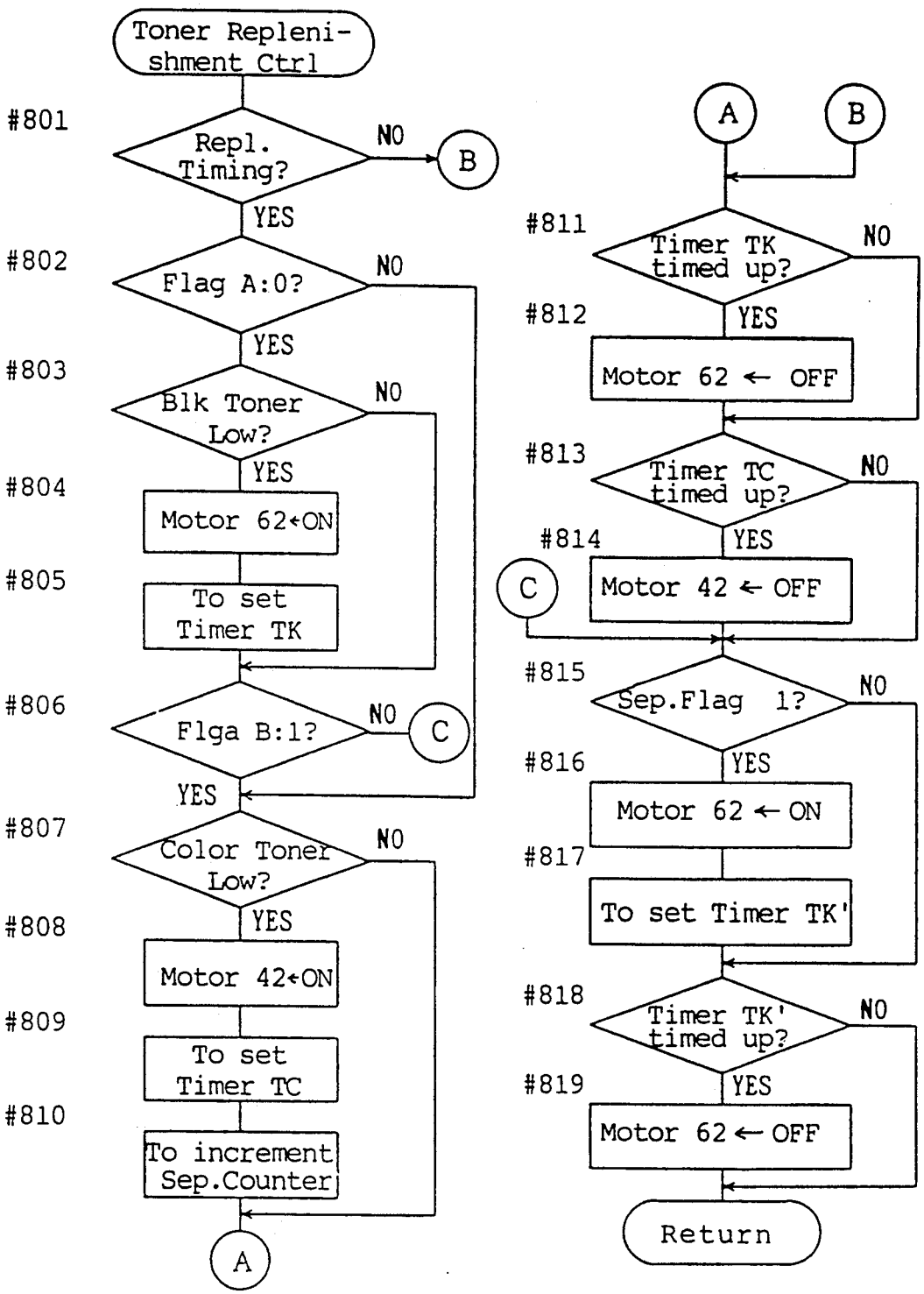
FIG. 15 is a flowchart showing a toner replenishment control subroutine executed in the image forming apparatus according to the third embodiment of the present invention.

Referring specifically to FIG. 13, the main routine of a printer control shown in and described with reference to FIG. 5 is modified to have a "Toner Replenish Ctrl Subroutine" step #6*a* which is executed subsequent to step #5 and prior to step #6, the details of which are best shown in FIG. 15. The use of the subroutine during which the second toner material is replenished into the second developing unit necessitates a modification to the separation mode control subroutine executed at step #5, i.e., after the execution of the Toner Replenish Ctrl Subroutine step #6*a*, as shown in FIG. 14.

Referring first to FIG. 14, subsequent to the start of the separation mode control subroutine, a decision is made at step #701 to determine if the count of a separation counter is n, that is, if the number of the resultant two-color image bearing prints has attained a predetermined value n. The count n of the separation counter is defined as a maximum acceptable number of the two-color image bearing prints formed by repeatedly performing a number of the two-color image forming cycles until the last copy of the two-color image bearing prints comes to show a noticeable mixed color, and can be empirically determined in consideration of the number of supply times over which the red or first toner material has been supplied from the toner hopper 41 into the first developing unit 4 and also with a relationship between the number of such supply times and the extent of color mixing observable in the two-color image bearing prints. In other words, after the two-color image forming process is performed repeatedly to produce the n number of the resultant two-color image bearing prints, a color mixed against the background of a black image will come to be noticeable. Therefore, if the result of decision at step #701 indicates that the count of the separation counter has reached n, the amount of the red or first toner material contained in the second developing unit 6 is detected in reference to the output 65 from the comparator 64 at step #702. Then at subsequent step #703, a decision is made to determine if the detected amount of the red toner material mixing into the second developing unit 6 is greater than a maximum allowable limit corresponding to the maximum allowable color mixing degree.

Should a result of decision at step #703 indicate that the amount of the red toner material mixing into the second developing unit 6 is greater than the maximum allowable limit, the program flow goes to step #704 at which the timer TB determinative of a recovery time, that is, the length of time during which the recovery of the red toner material from the second developing unit 6 is to be carried out, is set. On the other hand, if the result of decision at step #703 indicate that the amount of the red toner material mixing into the second developing unit 6 is smaller than the maximum allowable limit, the program flow goes to step #507.

Following step #704, and at step #705, a separation flag is set to "1", and the separation mode is subsequently executed, followed by step #706 at which the separation counter is reset to "0".

During an execution of the flow of steps #707 and #708, the separation mode is terminated. Specifically, at step #707 a decision is made to determine if the timer TB determinative of the length of time during which the separation mode is carried out has timed up, and if it has timed up, step #708 takes place to set the separation flag to "0" and, also, to bring all of the photoreceptor drum 1, the second developing unit 6 and the first electrostatic charger 2 to an inoperative position, thereby completing the separation mode.

Thereafter, a decision is made at step #709 to determine if the separation flag is "1", that is, if the separation mode is in progress. If step #709 indicates that the separation mode is in progress, another decision is made at step #710 to determine if the Print Start flag is set to "0". Should step #710 indicate that the Print Start flag is not set to "0", that is, any one of the print modes is not selected, the program flow goes to step #711 at which the potentials appropriate to the separation mode are set, followed by step #712 at which the various devices disposed around the photoreceptor drum and associated with the separation mode are set in a condition required to execute the separation mode. On the other hand, if the Print Start flag is set to "1", that is, if one of the print modes is executed, the separation mode is disabled and, therefore, there is no possibility that any one of the print modes and the separation mode take place at the same time.

With reference to FIG. 15, the details of the toner replenishment control subroutine will now be described. As hereinbefore described, this subroutine is executed at step #5*a* of the main flow of FIG. 13, that is, subsequent to the separation mode control subroutine and prior to the other processing subroutine. As shown in FIG. 15, subsequent to the start of the subroutine, a decision is made at step #801 to determine if it is a time to perform a toner replenishment. Should the decision at step #801 indicate that it is not the time to perform the toner replenishment, the program flow proceeds to step #811, but should the decision at step #801 indicate that it is the time to perform the toner replenishment, the program flow proceeds to step #802 at which another decision is made to determine if the flag A is "0". If the flag A is set to "0", that is, if any one of the black print mode and the two-color print mode is selected, the program flow goes to step #803, but if the flag A is set to "1", that is, if the color print mode is selected, the program flow goes to step #807.

At step #803, a decision is made to determine if the density of the black toner material within the second developing unit 6, that is, the mixing ratio of the amount of the black toner material relative to that of the carrier material, is lower than a predetermined value. If the density of the black toner material is lower than the predetermined value, a drive motor for effecting the replenishment of the black toner material is driven at step #804 so that the black toner material can be supplied from the toner hopper into the second developing unit 6, followed by step #805 at which a timer TK used to manage the length of replenishment time during which the replenishment is carried out is set, but if the density of the black toner material is higher than the predetermined value, the program flow goes to step #806 without effecting the toner replenishment.

At step #806, a decision is made to determine if the flag B is "1". If the flag B is "1", that is, if the two-color print mode is selected, the program flow proceeds to step #807, but if the flag B is "0", that is, if the black print mode is selected, the program flow jumps to step #815.

At step #807, a decision is made to determine if the density of the color toner material contained in the first developing unit 4 is lower than a predetermined value. If the density of the color toner material within the first developing unit 4 is determined to be lower than the predetermined value, the drive motor 42 for effecting the supply of the color toner material is driven at step #808, followed by step #809 at which a timer TC for managing the length of supply time during which the red toner material is supplied into the first developing unit 4 is set. Thereafter, at step #809, the separation counter is incremented by 1. During the execution of this subroutine, when one of the color print mode and the two-color print mode is selected and, at the same time, the color toner material is replenished into the first developing unit, the separation counter is incremented by 1 as described. It is to be noted that the density of the toner material contained in the developing material can be measured by the provision of, for example, a magnetic sensor which may be installed in each of the first and second developing units 4 and 6.

At step #811 following after either step #810 or step #801, a decision is made to determine if the timer TK has timed up. Should the timer TK be determined as having timed up, the drive motor 62 for the supply of the black toner material is switched off at step #812, followed by step #813, but should the timer TK be determined as having not timed up and in a process of counting, the program flow skips step #812 onto step #813.

At step #813, a decision is made to determine if the timer TC has timed up. Should the timer TC be determined as having timed up, the drive motor 42 for the supply of the color toner material is switched off at step #814, followed by step #815, but should the timer TK be determined as having not timed up and in a process of counting, the program flow skips step #814 onto step #815. Thereafter, at step #815, a decision is made to determine if the separation flag has been changed from "0" to "1". As hereinbefore described, this separation flag is changed to "1" when the number of the supply times over which the color toner material is supplied under the two-color print mode attains the predetermined value n.

Assuming that the separation flag is determined at step #815 as having been changed from "0" to "1", a replenishment of the black toner material for compensating a consumption thereof during the execution of the separation mode is effected. For this purpose, at step #816 the drive motor 62 for the supply of the black toner material is switched on and, before the program flow goes to step #818, a timer TK' determinative of the length of time during which the replacement of the black toner material is effected is set at step #817. On the other hand, unless the separation flag is not determined at step #815 as having been changed from "0" to "1", the program flow goes to step #818 without executing a flow of steps #816 and #817.

At step #818, a decision is made to determine if the timer TK' has timed up and, if it is determined as having timed up indicating that the replenishment of the black toner material has completed, the drive motor 62 for the supply of the black toner material is switched off at step #819, followed by a return to the main routine. On the other hand, if a result of decision at step #818 indicates that the timer TK' has not yet timed up and is in a process of counting, the program flow returns immediately to the main routine. In this way, the black toner material can be replenished into the second developing unit 6 in a quantity necessary to compensate for the quantity thereof consumed during the separation mode and, therefore, a proper amount of the black toner material can be substantially kept within the second developing unit 6 at all times.

According to the third preferred embodiment of the present invention as hereinabove described, the number of the supply times over which the color toner material is replenished into the first developing unit while one of the two-color print mode and the color print mode is selected and, when the number of such supply times attains the predetermined value, the separation mode is executed during which the color toner material mixing into the second developing unit 6 is separated and recovered from the second developing unit 6. In other words, no color toner substantially mix into the second developing unit 6 so long as the first developing unit 4 is not driven and, therefore, considering the case of any one of the two-color print mode and the color print mode, the amount of the color toner material mixing into the second developing unit 6 can be inferred.

It is to be noted that, during the execution of the toner replenishment control subroutine according to the third preferred embodiment of the present invention, steps #802 and #806 have been employed to determine if the flags A and B are either "0" or "1", respectively, so that, if the mode in which the color toner material is used, that is, one of the color print mode and the two-color print mode, is selected, the separation counter can be incremented by 1. However, arrangement may be made that the separation counter can be incremented by 1 only when the color toner material is replenished during the execution of the two-color print mode. This is because only the first developing unit 4 is driven during the color print mode and, in such case, the amount of the color toner material mixing into the second developing unit 6 is smaller than that during the two-color print mode and, therefore, the amount of the color toner material mixing into the second developing unit 6 can be substantially inferred if the number of the supply times over which the color toner material is replenished during the two-color print mode is counted.

Also, it has been described that the amount of the first toner material mixing into the second developing unit is measured by the use of the sensor 63 when the number of the supply times over which the color toner material is replenished into the first developing unit 4 and, if such amount exceeds the predetermined value, the first toner material is separated from the second developing unit 6. However, arrangement may be made that the separation mode can be automatically initiated when the number of the supply times attains the predetermined value n.

Moreover, it has been described that the second developing unit 6 has been described and shown as having the photoelectric sensor assembly to detect the mixing amount of the toner material. However, arrangement may be made that, while a patterned image is formed on the photoreceptor drum 1 by the utilization of only the second developing unit 6, the mixing amount of the toner material can be detected by detecting the density of the patterned image reflected from the photoreceptor drum.

Also, while it has been described that the separation mode is executed when the count of the separation counter has attained the predetermined value n, arrangement may be made that the separation mode can be executed if the separation switch 52 which may be provided in the printer is turned on.

From the foregoing description of the third preferred embodiment of the present invention, it is clear that, when the separation mode is executed, the second toner material can be replenished into the second developing unit. Accordingly, there is no substantial possibility that the density of the toner material contained in the second developing material will be lowered consequent upon the execution of the separation mode. This makes it possible that the density of the image formed by the use of the second developing unit can advantageously be stabilized, thereby providing clear image bearing prints.

Although the present invention has fully been described in connection with the various preferred embodiments thereof, the present invention can be modified in numerous ways without departing from the scope of the present invention as defined by the appended claims. By way of example, although in describing each of the preferred embodiments of the present invention reference has been made to the two-color printer, the present invention can be equally applicable to any other printer having a capability of making prints in three or more colors, that is, a so-called full color printer.

In addition, the means for recovering the toner material mixing into the second developing unit may not be always limited to the type wherein the toner material is deposited on the photoreceptor drum, but may be of a type including a recovery roll installed in the developing unit such as described under the "Description of the Related Art".

Accordingly, such changes and modifications are to be understood as included within the scope of the present invention as defined by the appended claims.

What is claimed is:

1. A multi-color image forming apparatus comprising:

a photosensitive medium;

a first latent image forming means for forming a first electrostatic latent image on the photosensitive medium;

a first developing unit for developing the first electrostatic latent image with a first toner material of a first color;

a second latent image forming means for forming a second electrostatic latent image on the photosensitive medium;

a second developing unit for developing the second electrostatic latent image with a second toner material of a second color different from the first color;

a removal means for removing the first toner material mixing into the second developing unit;

a detecting means for detecting an amount of the first toner material mixing into the second developing unit;

a manually operable switch for activating the removal means; and a control means for activating the removal means in the event that said manually operable switch is switched on and the amount of the first toner material detected by the detecting means is greater than a predetermined value.

2. A multi-color image forming apparatus comprising:

a photosensitive medium;

a latent image forming means for forming an electrostatic latent image on the photosensitive medium;

a first developing unit for developing the electrostatic latent image with a first toner material of a first color;

a second developing unit for developing the electrostatic latent image with a second toner material of a second color different from the first color;

a removal means for removing the first toner material mixing into the second developing unit;

a selector means for selecting one of a first mode, in which the electrostatic latent image is developed with the use of one of the developing units, and a second mode in which the electrostatic latent image is developed with the use of both of the first and second developing units;

a counting means for counting the number of times over which the electrostatic latent image is developed under the second mode; and a control means for activating the removal means in the event that said counting means counts a predetermined number of the times over which the electrostatic latent image has been developed under the second mode.

3. The apparatus as claimed in claim 2, wherein said control means activates the removal means for a predetermined period in response to the manually operable switch having been turned on.

4. A multi-color image forming apparatus comprising:

a photosensitive medium;

a latent image forming means for forming an electrostatic latent image on the photosensitive medium;

a first developing unit for developing the electrostatic latent image with a first toner material of a first color;

a second developing unit for developing the electrostatic latent image with a second toner material of a second color different from the first color;

a removal means for removing the first toner material mixing into the second developing unit;

a selector means for selecting one of a first mode, in which the electrostatic latent image is developed with the use of one of the developing units, and a second mode in which the electrostatic latent image is developed with the use of both of the first and second developing units;

a counting means for counting the number of times over which the electrostatic latent image is developed under the second mode;

a detecting means for detecting an amount of the first toner material mixing into the second developing unit; and a control means for activating the removal means in the event that said counting means counts a predetermined number of the times over which the electrostatic latent image has been developed under the second mode and the amount of the first toner detected by the detecting means exceeds a predetermined value.

5. A multi-color image forming apparatus comprising:

a photosensitive medium;

a first latent image forming means for forming a first electrostatic latent image on the photosensitive medium;

a first developing unit for developing the first electrostatic latent image with a first toner material of a first color;

a second latent image forming means for forming a second electrostatic latent image on the photosensitive medium;

a second developing unit for developing the second electrostatic latent image with a second toner material of a second color different from the first color;

a removal means for removing the first toner material mixing into the second developing unit; and a replenishing means for replenishing the second toner material into the second developing unit incident to an activation of the removal means.

6. The apparatus as claimed in claim 5, further comprising a manually operable switch for activating the removal means, and a control means for activating the removal means in response to the manually operable switch having been turned on.

7. The apparatus as claimed in claim 5, further comprising a selector means for selecting one of a first mode, in which an electrostatic latent image is developed with the use of one of the developing units, and a second mode in which an electrostatic latent image is developed with the use of both of the first and second developing units, a counting means for counting the number of times over which an electrostatic latent image is developed under the second mode, and a control means for activating the removal means in the event that said counting means counts a predetermined number of the times over which the electrostatic latent image has been developed under the second mode.

8. The apparatus as claimed in claim 5, further comprising a second replenishing means for replenishing the first toner material into the first developing unit, a counting means for counting the number of times over which the second replenishing means has been activated, and a control means for activating the removal means in the event that a count of said counting means attains a predetermined value.

9. A multi-color image forming apparatus comprising:

a photosensitive medium;

a first latent image forming means for forming a first electrostatic latent image on the photosensitive medium;

a first developing unit for developing the first electrostatic latent image with a first toner material;

a second latent image forming means for forming a second electrostatic latent image on the photosensitive medium;

a second developing unit for developing the second electrostatic latent image with a second toner material;

a removal means for removing the first toner material mixed into the second developing unit;

a replenishing means for replenishing the first toner material into the first developing unit;

a counting means for counting the number of times over which the replenishing means has been activated; and a control means for activating the removal means in the event that a count of said counting means attains a predetermined value.

10. A multi-color image forming apparatus comprising:

a photosensitive medium;

latent image forming means for forming an electrostatic latent image on the photosensitive medium;

a first developing unit for developing the electrostatic latent image with a first toner material;

a second developing unit for developing the electrostatic latent image with a second toner material;

a removal means for removing the first toner material mixed into the second developing unit;

a manually operable switch for activating the removal means; and a control means for activating the removal means in response to the manually operable switch having been turned on;

wherein the removal means is activated upon a turning on of a power-on switch of the image forming apparatus.

11. A multi-color image forming apparatus comprising:

a photosensitive medium;

latent image forming means for forming an electrostatic latent image on the photosensitive medium;

a first developing unit for developing the electrostatic latent image with a first toner material;

a second developing unit for developing the electrostatic latent image with a second toner material;

removal means for removing the first toner material mixed into the second developing unit;

a manually operable switch for activating the removal means;

a control means for activating the removal means in response to the manually operable switch having been turned on; and inhibiting means for inhibiting the operation of the removal means during operation of the latent image forming means.

12. A multi-color image forming apparatus comprising:

a photosensitive medium;

latent image forming means for forming an electrostatic latent image on the photosensitive medium;

a first developing unit for developing the electrostatic latent image with a first toner material of a first color;

a second developing unit for developing the electrostatic latent image with a second toner material of a second color different from the first color;

a removal means for removing the first toner material mixed into the second developing unit;

a detecting means for detecting an amount of the first toner material mixed into the second developing unit;

a manually operable switch for activating the removal means; and a control means for activating the removal means in the event that said manually operable switch is switched on and the amount of the first toner material detected by the detecting means is greater than a predetermined value.

13. A multi-color image forming apparatus comprising:

a photosensitive medium;

a latent image forming means for forming an electrostatic latent image on the photosensitive medium;

a first developing unit for developing the electrostatic latent image with a first toner material of a first color;

a second developing unit for developing the electrostatic latent image with a second toner material of a second color different from the first color;

a removal means for removing the first toner material mixed into the second developing unit;

a counting means for counting the number of times which the electrostatic latent image is developed with the use of both the first and second developing units; and a control means for activating the removal means in the event that said counting means counts a predetermined number of the times.

14. A multi-color image forming apparatus comprising:

a photosensitive medium;

a latent image forming means for forming an electrostatic latent image on the photosensitive medium;

a first developing unit for developing the electrostatic latent image with a first toner material of a first color;

a second developing unit for developing the electrostatic latent image with a second toner material of a second color different from the first color;

a removal means for removing the first toner material mixed into the second developing unit;

a selector means for selecting one of a first mode, in which the electrostatic latent image is developed with the use of one of the developing units, and a second mode in which the electrostatic latent image is developed with the use of both of the first and second developing units;

a counting means for counting the number of times over which the electrostatic latent image is developed under the second mode;

a detecting means for detecting an amount of the first toner material mixed into the second developing unit; and a control means for activating the removal means in the event that said counting means counts a predetermined number of the times over which the electrostatic latent image has been developed under the second mode and the amount of the first toner detected by the detecting means exceeds a predetermined value.

15. A multi-color image forming apparatus comprising:

a photosensitive medium;

a latent image forming means for forming an electrostatic latent image on the photosensitive medium;

a first developing unit for developing the electrostatic latent image with a first toner material of a first color;

a second developing unit for developing the electrostatic latent image with a second toner material of a second color different from the first color;

a removal means for removing the first toner material mixed into the second developing unit; and a replenishing means for replenishing the second toner material into the second developing unit in response to an activation of the removal means.

16. The apparatus as claimed in claim 15, further comprising a manually operable switch for activating the removal means, and a control means for activating the removal means in response to the manually operable switch having been turned on.

* * * * *